US010183767B2

(12) United States Patent
Zerial

(10) Patent No.: US 10,183,767 B2
(45) Date of Patent: Jan. 22, 2019

(54) BOX SPRING PACKAGING METHOD AND APPARATUS

(71) Applicant: Wolverine Automotive Board Sales, Inc., Monroe, MI (US)

(72) Inventor: Matthew Edward Zerial, Grand Rapids, MI (US)

(73) Assignee: WOLVERINE AUTOMOTIVE BOARD SALES, INC., Monroe, MI (US)

( * ) Notice: Subject to any disclaimer, the term of this patent is extended or adjusted under 35 U.S.C. 154(b) by 142 days.

(21) Appl. No.: 15/137,703

(22) Filed: Apr. 25, 2016

(65) Prior Publication Data

US 2016/0318680 A1 Nov. 3, 2016

Related U.S. Application Data

(60) Provisional application No. 62/179,166, filed on Apr. 29, 2015.

(51) Int. Cl.

| | |
|---|---|
| ***A47C 23/00*** | (2006.01) |
| ***B65B 13/02*** | (2006.01) |
| ***B65D 85/08*** | (2006.01) |
| *B65B 13/20* | (2006.01) |
| *B65B 25/00* | (2006.01) |
| *B65B 63/02* | (2006.01) |

(52) U.S. Cl.

CPC ..... *B65B 13/02* (2013.01); *A47C 23/00* (2013.01); *B65D 85/08* (2013.01); *B65B 13/20* (2013.01); *B65B 25/00* (2013.01); *B65B 63/02* (2013.01)

(58) Field of Classification Search

CPC ..... B65D 63/10; B65D 63/02; B65D 85/16; B65D 85/08; B65B 13/20; B65B 13/02; B65B 25/00; A47C 23/00

USPC ..... 206/446

See application file for complete search history.

(56) References Cited

U.S. PATENT DOCUMENTS

| | | | | |
|---|---|---|---|---|
| 4,826,714 | A * | 5/1989 | King | D21H 23/68 229/5.85 |
| 6,454,500 | B1 * | 9/2002 | Shetty | B60P 7/065 410/119 |
| 2004/0105600 | A1 * | 6/2004 | Floyd, Jr. | B65D 31/02 383/109 |
| 2008/0284071 | A1 * | 11/2008 | Knewtson | B65B 13/02 267/91 |

OTHER PUBLICATIONS

Tolko Industries Ltd., Kraft Unbleached SPX®—Vector Product Specifications, Kraft Papers Division, 1 page, Specifications in effect as of Jan. 1, 2015.

(Continued)

*Primary Examiner* — Anthony D Stashick
*Assistant Examiner* — James M Van Buskirk
(74) *Attorney, Agent, or Firm* — McGarry Bair PC

(57) ABSTRACT

Improved packaging materials for packaging multiple mattress spring cores together in a compressed stack, wherein the two ends of the stack are covered by end panels comprising a laminated paper stack panel that includes one or more layers of a stretchable paper called extensible kraft paper laminated together with a water soluble glue. The mattress spring cores are separated by an interleaving sheet comprising one layer of extensible kraft paper.

14 Claims, 4 Drawing Sheets

(56) References Cited

OTHER PUBLICATIONS

Tolko Industries Ltd., Kraft Unbleached SPX®—Velocity Primer Product Specifications, Kraft Papers Division, 1 page, Specifications in effect as of Jan. 1, 2015.
Tolko Industries Ltd., Kraft Paper Product Specifications, Kraft Papers Division, 16 pages, Specifications in effect as of Jan. 1, 2016, [accessed from Internet Apr. 25, 2016, http://tolko.com/resources/standardsspecifications].

* cited by examiner

POSSIBLE COMBINATIONS FOR END PANEL LAMINATIONS

| | | | | 2 PLIES OF EXTENSIBLE KRAFT | | | | 1 PLY OF EXTENSIBLE KRAFT | | |
|---|---|---|---|---|---|---|---|---|---|---|
| 3 PLIES OF EXTENSIBLE KRAFT | | | | 1 PLY OF LINERBOARD | | | | 2 PLIES OF LINERBOARD | | |
| ply 1 | ply 2 | ply 3 | | ply 1 | ply 2 | ply 3 | | ply 1 | ply 2 | ply 3 |
| 70EK | 100EK | 70EK | | 80EK | 26LB | 80EK | | 26LB | 80EK | 26LB |
| 65EK | 95EK | 65EK | | 75EK | 30LB | 75EK | | 30LB | 75EK | 30LB |
| 70EK | 90EK | 70EK | | 70EK | 33LB | 70EK | | 33LB | 70EK | 33LB |
| 75EK | 85EK | 75EK | | 65EK | 38LB | 65EK | | 38LB | 65EK | 38LB |
| 80EK | 80EK | 80EK | | 60EK | 42LB | 60EK | | 42LB | 60EK | 42LB |
| 80EK | 75EK | 80EK | | 55EK | 56LB | 55EK | | 56LB | 55EK | 56LB |
| 80EK | 70EK | 80EK | | 50EK | 69LB | 50EK | | 69LB | 50EK | 69LB |
| 80EK | 65EK | 80EK | | 80EK | 30HPLB | 80EK | | 30HPLB | 80EK | 30HPLB |
| 80EK | 60EK | 80EK | | 75EK | 33HPLB | 75EK | | 33HPLB | 75EK | 33HPLB |
| 80EK | 55EK | 80EK | | 70EK | 33HPLB | 70EK | | 33HPLB | 70EK | 33HPLB |
| 80EK | 50EK | 80EK | | 65EK | 33HPLB | 65EK | | 33HPLB | 65EK | 33HPLB |
| | | | | 60EK | 46HPLB | 60EK | | 46HPLB | 60EK | 46HPLB |
| | | | | 55EK | 52HPLB | 55EK | | 52HPLB | 55EK | 52HPLB |
| | | | | 50EK | 56HPLB | 50EK | | 56HPLB | 50EK | 56HPLB |

EK - EXTENSIBLE KRAFT (UNITS EXPRESSED IN POUNDS PER 3000 SQ. FT.)
LB - LINERBOARD (UNITS EXPRESSED IN POUNDS PER 1000 SQ. FT.)
HPLB - HIGH PERFORMANCE LINERBOARD (UNITS EXPRESSED IN POUNDS PER 1000 SQ. FT.)

NOTE:
The order or position of the plies when laminated is not critical.
The chart does not list all of the possible combinations or mean to limit the invention to those listed there.
There may be four or more plies in combination with extensible kraft, but 3 should be sufficient.

Fig. 4

BOX SPRING PACKAGING METHOD AND APPARATUS

CROSS-REFERENCE TO RELATED APPLICATIONS

This application claims priority under 35 U.S.C. § 119(e) to U.S. Provisional Patent Application No. 62/179,166, filed Apr. 29, 2015, entitled "BOX SPRING PACKAGING METHOD AND APPARATUS," which is herein incorporated by reference in its entirety.

FIELD OF THE INVENTION

The present invention relates to improved packaging processes and packaging materials for packaging of innerspring mattress cores for shipping, and more particularly to the use of improved end panels and interleaving sheets for packaging multiple innerspring mattress cores together in a compressed bundle.

BACKGROUND OF THE INVENTION

In the production of commercial innerspring mattresses, a metal coil innerspring "core" is covered with padding and a fabric cover. An innerspring core generally comprises a plurality of laterally spaced coil spring elements connected together in a rectangular array to form a spring mat.

At the present time, most of the metal coil innerspring cores are made at one location by a single manufacturer and then shipped to various other customer locations for incorporation in finished mattresses. Mattress manufacturers generally have their own brands, styles, technical specifications, and inner spring constructions to meet consumer's specific tastes.

Shipping of spring cores from the core manufacturer to the mattress manufacturers presents a challenge, because the spring cores are flexible and mostly air and take up a substantial amount of space. A process for shipping mattress cores has been developed and has been in use for many (at least twenty) years. However, the evolution of this process over the years has created numerous problems that have existed for many years, and these problems are continuing to get worse.

The current process for packaging spring cores involves placing an average of twelve cores in alignment on their edges within a horizontal hydraulic press so as to form a bale. A single sheet of core separator paper (called "interleaving paper") is positioned between each pair of spring cores in the bale in order to maintain the separation between adjacent spring core units when the cores are compressed together. Additionally, heavier laminated paper stock panels (referred to herein as "end panels") are placed on the exposed outer sides of the bale. At this time, up to three employees puncture the unit from one side of the cores to the other using fifteen foot spears (up to 40 spears total) as fast as they can, aligning the spears through the same hole locations in each of the individual innerspring cores. Spearing the bale is a critical part of the process, because without the spears to guide and hold the spring cores in alignment, the cores would slip sideways out of alignment during compression. The bale is then compressed to about a fifteen inch thick sandwich and is held together using wood braces and/or tie wires or banding during transit. The baled "crate" is generally under about 18,000 lbs. of pressure, so the packaging is very critical.

For many years, there were no standard specifications for the interleaving paper placed between the individual innerspring cores or for the end panels placed on the outer sides of the stack of innerspring cores. As in any business, the cost of packaging can be a major concern, especially in such a high volume and packaging intensive product line as this. Therefore, at first many manufacturers would use the least expensive material available, often odd lot or rejected papers from other applications, which came in many different types and combinations. The result for the end converter (i.e., the finished mattress manufacturer) was inconsistency, product damage, and a generally unsafe working environment. It was not uncommon to find that when a bale was opened the interleaving paper was shredded into little pieces. This would cause the innersprings to become entangled and need repair if not rejected outright; both an added cost for the manufacturer. Likewise, substandard laminated cardboard used for the end panels would break, allowing the springs to jut out and become deformed, thereby damaging them as well.

Approximately twenty-five years ago, standard specifications were created detailing the requirements for the interleaving paper and end panels used in this application. In the original specification, around 1990, the end panels were specified as a lamination of two layers of heavy paper called "linerboard" (which is a type of heavy paper stock used in the manufacture of corrugated cardboard boxes) having a basis weight of 42 pounds per 1000 square feet (sq. ft.) per layer (which provides a total of 84 pounds per 1000 square feet for the two layers). The interleaving material was specified as a single layer of paper stock known as "natural kraft paper" (which is commonly used for wrapping paper, sandwich liner, and food packaging) having a basis weight of 50 lbs. per 3000 sq. ft. (about 17 lbs. per 1000 sq. ft.) (lighter kraft papers such as these are generally specified in nominal units of pounds per 3000 square feet).

Over the years, innerspring compression strength increased substantially, so it became necessary to increase the strength of the interleaving and end panel materials.

Around the year 2000, end panels were first increased from their original 1990 construction, wherein the end panel on each end of the stack consisted of two laminated plies of 42 lb. linerboard, to a construction employing two layers of the two ply 42 lb. linerboard at each end of the stack. This was later reduced to a three ply lamination of 42 lb. linerboard in 2010. Presently, a four ply 42 lb. linerboard end panel is being considered for specific units that are having higher than normal failure rates due to pressure-related rupture.

Interleaving materials likewise have increased in basis weight (heavier, stronger), first in 1995 from one layer to two layers (not glued) of natural kraft paper having a basis weight of 50 pounds per 3000 sq. ft. Then a single layer of 26 lb. per 1000 sq. ft. linerboard was substituted for the two layers of natural kraft paper in 2000. This was increased to two layers of 26 pound linerboard in 2010. The current specification is one layer of 33 lb. linerboard. One layer of 42 lb. linerboard is projected for the future.

The increased thickness of the end panels and interleaving has created two problems, first an increase in shipping costs due to the increased weight of packaging material used, and second, increased difficulty in piercing the end panels and interleaving layers prior to compressing the coil spring mattresses. The difficulties in piercing existing and future thicknesses of materials and the expense of the materials make it undesirable to continue to increase the thickness of interleaving sheets and end panels as spring compression strength continues to increase.

An object of the present invention is to provide improved end panels and interleaving materials for packaging innerspring mattresses for shipping so as to facilitate packaging and reduce shipping costs.

Another object of the present invention is to provide an improved process for packaging compressed innersprings using the improved end panels and interleaving.

SUMMARY OF THE INVENTION

The present invention provides in a first embodiment a package of compressed mattress spring coils comprising a plurality of mattress spring coils positioned in a stack having two end panels positioned on each end of an outer side of the stack wherein the stack is compressed and strapped in a compressed condition. The mattress spring coils are each separated by a piece of interleaving paper. The end panels comprise a laminated paper stack panel having at least one layer of an extensible kraft paper.

The present invention provides in a second embodiment a package of compressed mattress spring coils comprising a plurality of mattress spring coils positioned in a stack having two end panels positioned on each end of an outer side of the stack. The stack is compressed and strapped in a compressed condition. The mattress spring coils are each separated by a piece of interleaving paper comprising a layer of an extensible kraft paper.

The present invention provides in a third embodiment a process for packaging a plurality of mattress spring coils. One step is the positioning of the plurality of mattress spring coils in a stack with a piece of interleaving paper between each of the mattress spring coils. Another step is applying two end panels positioned on each end of an outer side of the stack. Another step is compressing and then strapping the plurality of mattress spring coils, the piece of interleaving paper, and the two end panels in a compressed condition. The end panels comprise a laminated paper stock panel comprising at least one layer of an extensible kraft paper having a basis weight of 35-150 pounds per 3000 sq. ft.

The present invention provides in a fourth embodiment a package of compressed mattress spring coils comprising a plurality of mattress spring coils positioned in a stack having two end panels positioned on each end of an outer side of the stack wherein the stack is compressed and strapped in a compressed condition. The mattress spring coils are each separated by a piece of interleaving paper. The end panels comprise a laminated paper stack panel having at least one layer of an extensible kraft paper. The laminated paper stack panel comprises two layers of the extensible kraft paper, each layer of extensible kraft paper having a basis weight of 35-150 pounds per 3000 sq. ft., laminated with a water soluble glue to one layer of a linerboard having a basis weight of 10-90 pounds per 1000 sq. ft.

The present invention provides in a fifth embodiment a package of compressed mattress spring coils comprising a plurality of mattress spring coils positioned in a stack having two end panels positioned on each end of an outer side of the stack wherein the stack is compressed and strapped in a compressed condition. The mattress spring coils are each separated by a piece of interleaving paper. The end panels comprise a laminated paper stack panel having at least one layer of an extensible kraft paper. The laminated paper stack panel comprises three layers of the extensible kraft paper, each layer of extensible kraft paper having a basis weight of 35-150 pounds per 3000 sq. ft.

These constructions do not preclude the use of additional layers of material if such is desired, but additional layers should not be necessary at the present time and could reduce some of the benefits of the preferred construction.

These and other features, advantages, and objects of the present invention will be further understood and appreciated by those skilled in the art by reference to the following specification, claims, and appended drawings.

BRIEF DESCRIPTION OF THE DRAWINGS

FIG. 4 is a chart showing various alternative end panel constructions feasible in the present invention.

DETAILED DESCRIPTION

Figure 1:
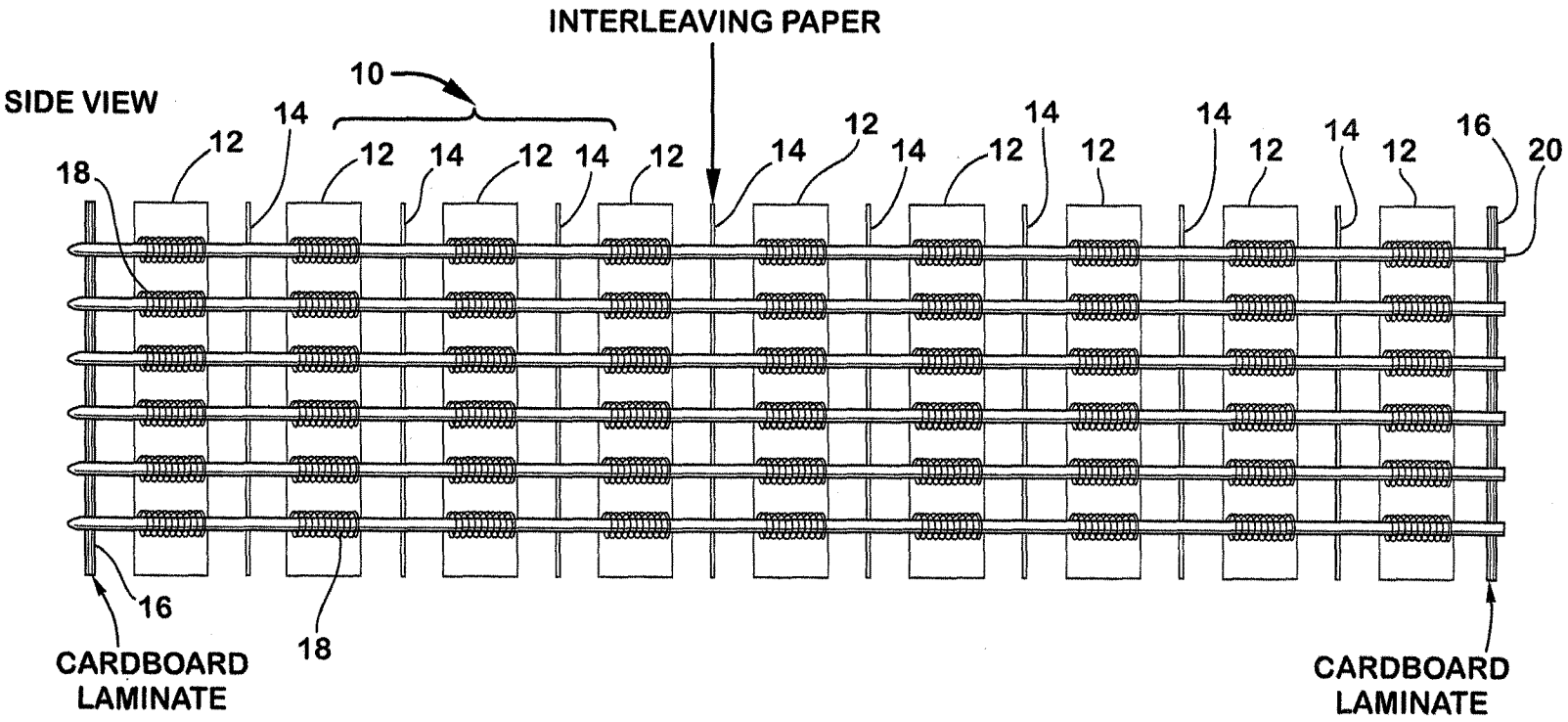
FIG. 1 is a schematic side view of a stack of mattress coil springs separated by interleaving sheets prior to being compressed together.

Referring to the drawings, FIG. 1 shows a stack 10 of mattress spring cores 12 or mattress spring coils 12 separated by interleaving paper 14 and having end panels 16 on the outer ends of the stack. The individual mattress spring cores 12 each comprise a plurality of spaced coil spring elements 18 fastened together to form a spring coil mat. The coils 18 in overlapping mattress cores 12 are in general alignment.

The stack 10 or plurality of mattress spring coils 12 can comprise 4-15 mattress spring coils, 6-12 mattress spring coils, 8-10 mattress spring coils, about 6 mattress spring coils, about 7 mattress spring coils, about 8 mattress spring coils, about 9 mattress spring coils, about 10 mattress spring coils, about 11 mattress spring coils, or about 12 mattress spring coils.

The term "extensible kraft paper", as used herein refers to fully extensible kraft paper, semi-extensible kraft paper, and any other specialty grades of extensible kraft paper known to one with ordinary skill in the art.

The term "linerboard", as used herein refers to linerboard, natural kraft paper, high performance linerboard, and any other specialty grades of linerboard known to one with ordinary skill in the art.

In one embodiment, the interleaving paper 14 is a single layer or piece of extensible kraft paper having a basis weight of 35-150 pounds per 3000 sq. ft. In another embodiment, the interleaving paper can be two layers of non-laminated extensible kraft paper, each layer or piece of extensible kraft paper having a basis weight of 35-150 pounds per 3000 sq. ft. In another embodiment, the interleaving paper can be three or more layers or pieces of non-laminated extensible kraft paper, each layer or piece of extensible kraft paper having a basis weight of 35-150 pounds per 3000 sq. ft.

In some embodiments, the extensible kraft paper may have a basis weight of 30-150 pounds per 3000 sq. ft. In other embodiments, the extensible kraft paper may have a basis weight of 50-100 pounds per 3000 sq. ft. In other embodiments, the extensible kraft paper may have a basis weight of 50-75 pounds per 3000 sq. ft. In other embodiments, the extensible kraft paper may have a basis weight of about 50 pounds per 3000 sq. ft., about 55 pounds per 3000 sq. ft., about 60 pounds per 3000 sq. ft., about 65 pounds per 3000 sq. ft., about 70 pounds per 3000 sq. ft., or about 75 pounds per 3000 sq. ft.

Figure 2:
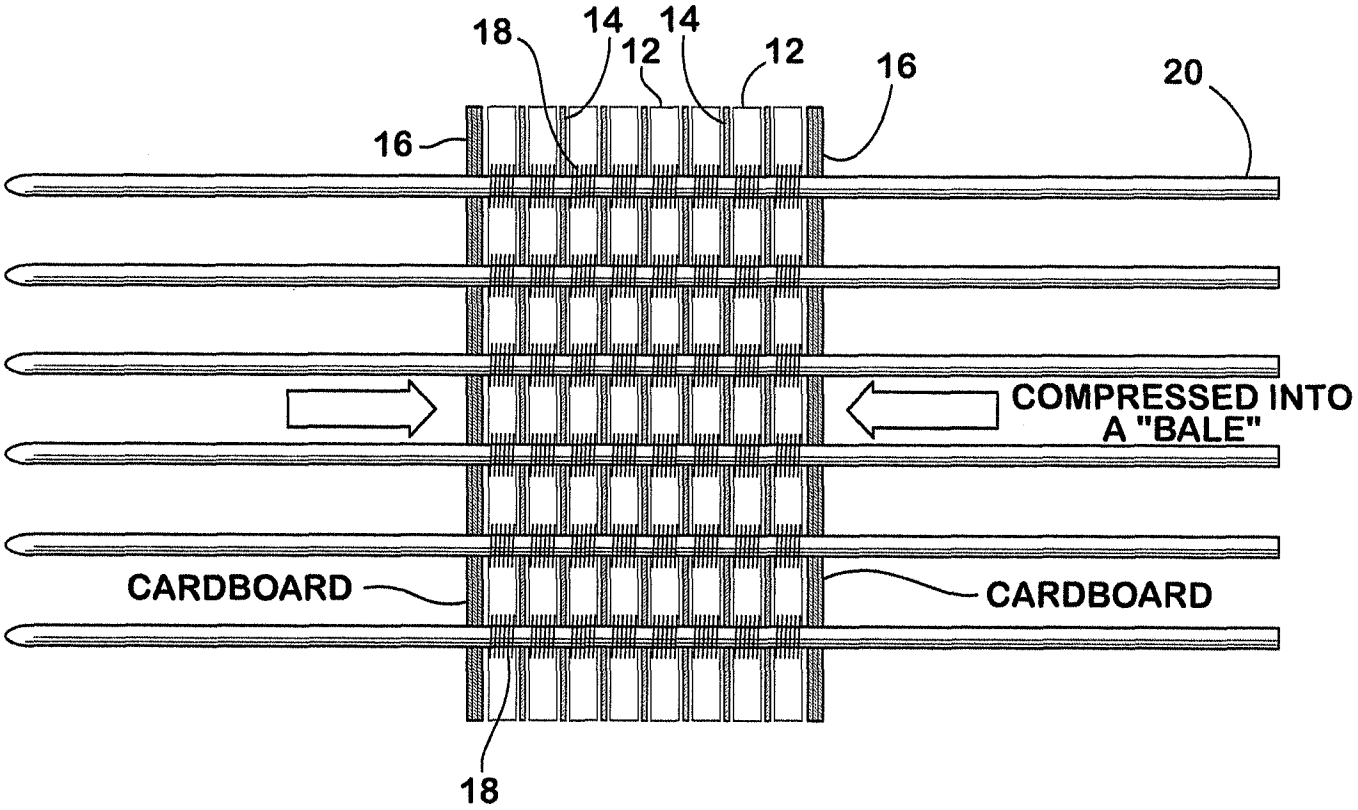
FIG. 2 is a schematic side view showing a compressed stack of mattress cores separated by interleaving sheets and having end panels on the outer sides thereof and being bound together in compressed form for shipping.
Figure 3:
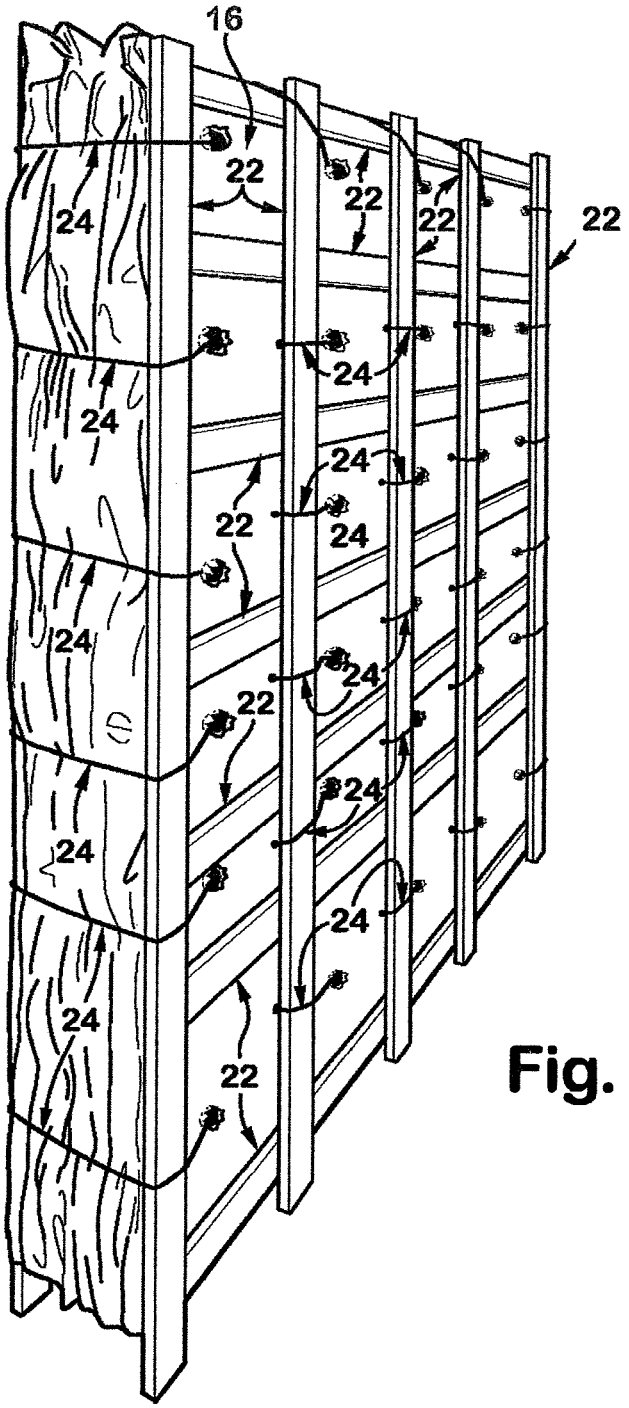
FIG. 3 is a perspective view showing the compressed and bound stack of mattress cores.

After the stack 10 of mattress cores 12 has been formed with the interleaving papers 14 and end panels 16 in place, a plurality of spears 20 (FIG. 2) are inserted through the coils 18 and through the end panels 16 and interleaving sheets 14 in order to hold the coils in alignment for compression. The coils 18 are shown in their uncompressed state in FIG. 1. Wood boards of panels 22 (FIG. 3) are then placed against the outer sides of the stack 10 and the stack 10 is compressed in a press, generally a horizontal hydraulic press. The mattress spring cores 12 are shown in a compressed bundle in FIG. 2. When the bundle of mattress spring cores 12 and coil spring elements 18 are fully compressed, the bundle is bound together in the compressed state by conventional bands, straps, or tie wires 24 (FIG. 3). The bundle is thereafter shipped to its destination, where the mattress spring cores 12 are then unbundled and decompressed, and the individual mattress spring cores 12 are thereafter covered with padding and fabric in order to complete the mattress construction.

One important feature of the present invention is that the end panels 16 positioned on the outer sides of the stacks are relatively thin, easily pierceable members formed of a lamination or a laminated paper stack panel comprising at least one and up to three layers of extensible kraft paper laminated together with water soluble glue. Other types of glue known in the art for adhering paper layer may be used. The use of "extensible" kraft paper instead of the conventional linerboard is important. Extensible kraft paper is a specific type of relatively thin paper that has been subjected to additional processing during manufacture that makes the paper somewhat stretchable. This type of paper is generally used in cement bag or bag applications with a single ply or two plies of a non-laminated paper which benefits from being somewhat stretchable. Generally, extensible kraft paper is not used in laminated paper products. The stretchability and thinness of extensible kraft papers generally make them undesirable for use in laminated paper products, because thin and stretchy paper cannot be used in known automated laminating machinery and can only be processed in smaller batches. Notwithstanding the increased material cost on a unit weight basis and notwithstanding the added manufacturing cost of a non-automated laminating process, the use of laminated extensible kraft paper in the end panels provides cost savings and performance benefits in the present invention. Likewise, the use of extensible kraft paper for the interleaving paper provides desirable strength and tear resistance while retaining desirable pierce-ability attributes.

While some embodiments of the present invention employ end panels 16 formed of three layers of extensible kraft paper laminated together with a water soluble glue, other constructions are feasible. For example, the end panels can be formed by gluing two layers of extensible kraft paper with one layer of linerboard, or the end panels can be formed by gluing one layer of extensible kraft paper with two layers of linerboard. Multiple examples of feasible laminate constructions are shown in FIG. 4. FIG. 4 is not meant to be limiting since other combinations of laminate layers in light of this disclosure could be determined.

When the laminated end panels or laminated paper stack panel comprises three layers of extensible kraft paper, the individual weights of the three different paper layers may all vary. As shown in FIG. 4, the first layer or ply of the three layers of extensible kraft paper can have a basis weight of 35-150 pounds per 3000 sq. ft. In some embodiments the first ply can have a basis weight of about 65 pounds per 3000 sq. ft., a basis weight of about 70 pounds per 3000 sq. ft., a basis weight of about 75 pounds per 3000 sq. ft., or a basis weight of about 80 pounds per 3000 sq. ft. The second layer or ply of the three layers of extensible kraft paper can have a basis weight of 35-150 pounds per 3000 sq. ft. In some embodiments the second ply can have a basis weight of about 50 pounds per 3000 sq. ft., a basis weight of about 55 pounds per 3000 sq. ft., a basis weight of about 60 pounds per 3000 sq. ft., a basis weight of about 65 pounds per 3000 sq. ft., a basis weight of about 70 pounds per 3000 sq. ft., a basis weight of about 75 pounds per 3000 sq. ft., a basis weight of about 80 pounds per 3000 sq. ft., a basis weight of about 85 pounds per 3000 sq. ft., a basis weight of about 90 pounds per 3000 sq. ft., a basis weight of about 95 pounds per 3000 sq. ft., or a basis weight of about 100 pounds per 3000 sq. ft. The third layer or ply of the three layers of extensible kraft paper can have a basis weight of 35-150 pounds per 3000 sq. ft. In some embodiments the third ply can have a basis weight of about 65 pounds per 3000 sq. ft., a basis weight of about 70 pounds per 3000 sq. ft., a basis weight of about 75 pounds per 3000 sq. ft., or a basis weight of about 80 pounds per 3000 sq. ft.

When the laminated end panels or laminated paper stack panel comprises two layers of extensible kraft paper and one layer of linerboard, the individual weights of the three different layers may all vary. As shown in FIG. 4, the first layer or ply of extensible kraft paper can have a basis weight of 35-150 pounds per 3000 sq. ft. In some embodiments the first ply can have a basis weight of about 50 pounds per 3000 sq. ft., a basis weight of about 55 pounds per 3000 sq. ft., a basis weight of about 60 pounds per 3000 sq. ft., a basis weight of about 65 pounds per 3000 sq. ft., a basis weight of about 70 pounds per 3000 sq. ft., a basis weight of about 75 pounds per 3000 sq. ft., or a basis weight of about 80 pounds per 3000 sq. ft. The second layer or ply made of linerboard can have a basis weight of 10-90 pounds per 1000 sq. ft. In some embodiments the second ply can have a basis weight of about 26 pounds per 1000 sq. ft., a basis weight of about 30 pounds per 1000 sq. ft., a basis weight of 33 pounds per 1000 sq. ft., a basis weight of 38 pounds per 1000 sq. ft., a basis weight of 42 pounds per 1000 sq. ft., a basis weight of 56 pounds 1000 sq. ft., or a basis weight of 69 per 1000 sq. ft. The third layer or ply of extensible kraft paper can have a basis weight of 35-150 pounds per 3000 sq. ft. In some embodiments the third ply can have a basis weight of about 50 pounds per 3000 sq. ft., a basis weight of about 55 pounds per 3000 sq. ft., a basis weight of about 60 pounds per 3000 sq. ft., a basis weight of about 65 pounds per 3000 sq. ft., a basis weight of about 70 pounds per 3000 sq. ft., a basis weight of about 75 pounds per 3000 sq. ft., or a basis weight of about 80 pounds per 3000 sq. ft.

When the laminated end panels or laminated paper stack panel comprises one layer of extensible kraft paper and two layers of linerboard, the individual weights of the three different layers may all vary. As shown in FIG. 4, the first layer or ply of linerboard can have a basis weight of 10-90 pounds per 1000 sq. ft. In some embodiments the first ply can have a basis weight of about 26 pounds per 1000 sq. ft., a basis weight of about 30 pounds per 1000 sq. ft., a basis weight of 33 pounds per 1000 sq. ft., a basis weight of 38 pounds per 1000 sq. ft., a basis weight of 42 pounds per 1000 sq. ft., a basis weight of 56 pounds 1000 sq. ft., or a basis weight of 69 per 1000 sq. ft. The second layer or ply of extensible kraft paper can have a basis weight of 35-150 pounds per 3000 sq. ft. In some embodiments the second ply can have a basis weight of about 50 pounds per 3000 sq. ft., a basis weight of about 55 pounds per 3000 sq. ft., a basis weight of about 60 pounds per 3000 sq. ft., a basis weight of about 65 pounds per 3000 sq. ft., a basis weight of about 70 pounds per 3000 sq. ft., a basis weight of about 75 pounds per 3000 sq. ft., or a basis weight of about 80 pounds per 3000 sq. ft. The third layer or ply of linerboard can have a basis weight of 10-90 pounds per 1000 sq. ft. In some embodiments the third ply can have a basis weight of about 26 pounds per 1000 sq. ft., a basis weight of about 30 pounds per 1000 sq. ft., a basis weight of 33 pounds per 1000 sq. ft., a basis weight of 38 pounds per 1000 sq. ft., a basis weight of 42 pounds per 1000 sq. ft., a basis weight of 56 pounds 1000 sq. ft., or a basis weight of 69 per 1000 sq. ft.

The laminated end panels or laminated paper stack panel are made of paper layers comprising extensible kraft paper and/or layers of linerboard. The strength and/or weight of the laminated end panels or laminated paper stack is normally the cumulative value of the individual layers laminated together plus any residual strength or weight added by the glue. For example, a single layer of extensible kraft paper having a basis weight of 100 pounds per 3000 square feet laminated with a single layer of linerboard having a basis weight of 270 pounds per 3000 sq. ft. would yield a laminated end panel or laminated paper stack panel of 370 pounds per 3000 sq. ft.

In some embodiments, the ordering or layering of the individual layers in the laminated end panels or laminated paper stack panels do not matter. For example, if the laminated paper stack panel comprises two layers of an extensible kraft paper and one layer of a linerboard, the layering could be the linerboard sandwiched between the two extensible kraft paper layers or the layering could be a layer of extensible kraft paper on top of a layer of extensible kraft paper with the layer of linerboard added last to the top or bottom. In some embodiments, the ordering or layering of the individual layers in the laminated end panels or laminated paper stack panels are not limiting and may be in any order.

In one embodiment of the invention, the laminated end panels each comprise three layers of extensible kraft paper, each layer of extensible kraft paper having a basis weight of 35-150 pounds per 3000 square feet.

In another embodiment, the end panels comprise a laminated paper stack panel of at least one and up to two layers of extensible kraft paper, each layer of extensible kraft paper having a basis weight of 35-150 pounds per 3000 sq. ft., in combination with a layer of linerboard having a basis weight of 10-90 pounds per 1000 sq. ft.

In another embodiment, the end panels comprise a laminated paper stack panel of one layer of extensible kraft paper having a basis weight of 35-150 pounds per 3000 sq. ft. in combination with two layers of linerboard, each layer of linerboard having a basis weight of 10-90 pounds per 1000 sq. ft.

Mullen is a measure of the bursting strength of paper or paperboard. In a Mullen test (also called a pop or burst test), the paper sample is placed between two ring-like clamps in a device called a Mullen tester, and hydraulic pressure is used to inflate a rubber diaphragm, which expands against the sample stretching it. The measure of the total hydraulic pressure expanding the diaphragm at the time the sample ruptures (usually expressed in either pounds per square inch or kilopascals) is its bursting strength. Mullen tests are performed for each side of a paper or paperboard, and the bursting strength can be expressed as the average of both sides.

In one embodiment, the laminated paper stack panel has a mullen from 100 psi to 800 psi. In another embodiment, the laminated paper stack panel has a mullen from 200 psi to 600 psi. In another embodiment, the laminated paper stack panel has a mullen from 300 psi to 500 psi. In another embodiment, the laminated paper stack panel has a mullen from 250 psi to 400 psi. In another embodiment, the laminated paper stack panel has a mullen of about 300 psi, about 350 psi, about 400 psi, about 450 psi, or about 500 psi.

In one embodiment, the interleaving paper has a mullen from 30 psi to 270 psi. In another embodiment, the interleaving paper has a mullen from 50 psi to 175 psi. In another embodiment, the interleaving paper has a mullen from 70 psi to 100 psi.

It should be understood that the foregoing is merely exemplary of the preferred practice of the present invention and that various modifications may be made in the arrangements and details of the construction of the present invention without departing form the spirit and scope of the present invention.

The invention claimed is:

1. A package of compressed mattress spring coils comprising a plurality of mattress spring coils positioned in a stack having two end panels positioned on each end of an outer side of the stack wherein the stack is compressed and strapped in a compressed condition:

wherein the mattress spring coils are each separated by a piece of interleaving paper;

wherein the end panels comprise a laminated paper stack panel wherein the laminated paper stack panel includes at least one layer of an extensible kraft paper;

wherein the laminated paper stack panel has a mullen from 200 psi to 600 psi; and wherein the piece of interleaving paper separating the mattress spring coils comprises a layer of the extensible kraft paper having a basis weight of 35-150 pounds per 3000 sq. ft.

2. The package of compressed mattress spring coils according to claim 1, wherein the extensible kraft paper has a basis weight of 35-150 pounds per 3000 sq. ft.

3. The package of compressed mattress spring coils according to claim 1, wherein the laminated paper stack panel comprises three layers of extensible kraft paper, each layer of extensible kraft paper having a basis weight of 35-150 pounds per 3000 sq. ft.

4. The package of compressed mattress spring coils according to claim 1, wherein the laminated paper stack panel comprises two layers of the extensible kraft paper, each layer of extensible kraft paper having a basis weight of 35-150 pounds per 3000 sq. ft., laminated with a water soluble glue to one layer of a linerboard having a basis weight of 10-90 pounds per 1000 sq. ft.

5. The package of compressed mattress spring coils according to claim 1, wherein the laminated paper stack panel comprises one layer of the extensible kraft paper having a basis weight of about 35-150 pounds per 3000 sq. ft. laminated with a water soluble glue to two layers of a linerboard, each layer of linerboard having a basis weight of 10-90 pounds per 1000 sq. ft.

6. A package of compressed mattress spring coils comprising a plurality of mattress spring coils positioned in a stack having two end panels positioned on each end of an outer side of the stack wherein the stack is compressed and strapped in a compressed condition:

wherein the mattress spring coils are each separated by a piece of interleaving paper;

wherein the end panels comprise a laminated paper stack panel wherein the laminated paper stack panel includes at least one layer of an extensible kraft paper with a basis weight of 35-150 pounds per 3000 sq. ft; and wherein the laminated paper stack panel has a mullen from 100 psi to 800 psi; and wherein the laminated paper stack panel includes at least two layers of the extensible kraft paper with a basis weight of 35-150 pounds per 3000 sq. ft.

7. The package of compressed mattress spring coils according to claim 6, wherein the laminated paper stack panel includes three layers of extensible kraft paper, each layer of extensible kraft paper having a basis weight of 35-150 pounds per 3000 sq. ft.

8. The package of compressed mattress spring coils according to claim 6, wherein the laminated paper stack panel includes two layers of extensible kraft paper, each layer of extensible kraft paper having a basis weight of 35-150 pounds per 3000 sq. ft., laminated with a water soluble glue to one layer of linerboard having a basis weight of 10-90 pounds per 1000 sq. ft.

9. The package of compressed mattress spring coils according to claim 6, wherein the laminated paper stack panel includes one layer of extensible kraft paper having a basis weight of 35-150 pounds per 3000 sq. ft. laminated with a water soluble glue to two layers of linerboard, each layer of the linerboard having a basis weight of 10-90 pounds per 1000 sq. ft.

10. The package of compressed mattress spring coils according to claim 6, wherein the laminated paper stack panel has a mullen from 250 psi to 400 psi.

11. A package of compressed mattress spring coils comprising a plurality of mattress spring coils positioned in a stack having two end panels positioned on each end of an outer side of the stack wherein the stack is compressed and strapped in a compressed condition:

wherein the mattress spring coils are each separated by a piece of interleaving paper;

wherein the end panels comprise a laminated paper stack panel wherein the laminated paper stack panel includes at least one layer of an extensible kraft paper with a basis weight of 35-150 pounds per 3000 sq. ft; and wherein the laminated paper stack panel has a mullen from 100 psi to 800 psi; and wherein the laminated paper stack panel has a mullen from 250 psi to 400 psi.

12. The package of compressed mattress spring coils according to claim 11, wherein the laminated paper stack panel includes three layers of extensible kraft paper, each layer of extensible kraft paper having a basis weight of 35-150 pounds per 3000 sq. ft.

13. The package of compressed mattress spring coils according to claim 11, wherein the laminated paper stack panel includes two layers of extensible kraft paper, each layer of extensible kraft paper having a basis weight of 35-150 pounds per 3000 sq. ft., laminated with a water soluble glue to one layer of linerboard having a basis weight of 10-90 pounds per 1000 sq. ft.

14. The package of compressed mattress spring coils according to claim 11, wherein the laminated paper stack panel includes one layer of extensible kraft paper having a basis weight of 35-150 pounds per 3000 sq. ft. laminated with a water soluble glue to two layers of linerboard, each layer of the linerboard having a basis weight of 10-90 pounds per 1000 sq. ft.

* * * * *